US011796938B2

(12) United States Patent
Tejima

(10) Patent No.: US 11,796,938 B2
(45) Date of Patent: Oct. 24, 2023

(54) TRANSFER DEVICE AND IMAGE FORMING APPARATUS

(71) Applicant: FUJIFILM Business Innovation Corp., Tokyo (JP)

(72) Inventor: Satoshi Tejima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/898,477

(22) Filed: Aug. 29, 2022

(65) Prior Publication Data

US 2023/0305443 A1 Sep. 28, 2023

(30) Foreign Application Priority Data

Mar. 23, 2022 (JP) ..... 2022-047575

(51) Int. Cl.
*G03G 15/16* (2006.01)
*G03G 15/01* (2006.01)

(52) U.S. Cl.
CPC ..... *G03G 15/1605* (2013.01); *G03G 15/0189* (2013.01); *G03G 2215/0158* (2013.01); *G03G 2215/1623* (2013.01)

(58) Field of Classification Search
CPC ..... G03G 15/0189; G03G 15/1605; G03G 15/5008; G03G 15/5054; G03G 15/6561; G03G 2215/0158; G03G 2215/0161
See application file for complete search history.

(56) References Cited

U.S. PATENT DOCUMENTS

2017/0205750 A1* 7/2017 Takahashi ..... G03G 15/5058
2017/0235266 A1* 8/2017 Ino ..... G03G 15/0131 399/301
2020/0057404 A1* 2/2020 Ino ..... G03G 15/5058

FOREIGN PATENT DOCUMENTS

JP 2004029525 1/2004
JP 2010066451 3/2010

* cited by examiner

*Primary Examiner* — Hoang X Ngo
(74) *Attorney, Agent, or Firm* — JCIPRNET

(57) ABSTRACT

A transfer device includes: an endless member in an endless shape that orbits; primary transfer members that are respectively arranged on an opposite side of plural image holding bodies disposed side by side in a circumference direction of the endless member with the endless member interposed between the primary transfer member and the image holding body, and transfer an image held by the image holding body to the endless member; a secondary transfer member that transfers the image transferred to the endless member to a recording medium; an applying roll around which the endless member is wound, that is disposed on a downstream side of all the primary transfer members and on an upstream side of the secondary transfer member in the circumference direction, and that urges the endless member from an inner peripheral surface of the endless member to apply tension to the endless member; an upstream roll around which the endless member is wound, and that is disposed on the downstream side of all the primary transfer members and on an upstream side of the applying roll in the circumference direction; a contact and detachment member that moves at least some of the plural primary transfer members, and contacts and detaches the endless member and the image holding body to change a posture of the endless member; a detection member that faces a portion of the endless member between the upstream roll and the applying roll to detect the (Continued)

image transferred to the endless member; and a positioning mechanism that changes a posture of the detection member according to the change in the posture of the endless member to position the detection member at the endless member.

20 Claims, 7 Drawing Sheets

TRANSFER DEVICE AND IMAGE FORMING APPARATUS

CROSS-REFERENCE TO RELATED APPLICATIONS

This application is based on and claims priority under USC 119 from Japanese Patent Application No. 2022-047575 filed Mar. 23, 2022.

BACKGROUND

(i) Technical Field

The present invention relates to a transfer device and an image forming apparatus.

(ii) Related Art

An image forming apparatus described in JP2004-29525A includes an image forming section that forms a toner image, a supporting medium capable of supporting a detection toner image formed by the image forming section, a holding section that holds and drives the supporting medium, a detection section that detects the detection toner image on the supporting medium, and a control section that controls an image forming condition by detection information of the detection section, in which a positioning section that determines a detection position of the detection section provided in the holding section is provided, and the detection section is disposed to detect the detection toner image on the supporting medium on the holding section.

SUMMARY

A transfer device includes a primary transfer member that transfers an image of each color to each endless member, and a detection member that detects the image transferred to the endless member. This detection member is disposed to face a belt surface of the endless member.

Here, there is a mode in which the position of the primary transfer member is different, and a posture of the endless member is changed. Therefore, the detection member is disposed to face the endless member of a portion wound on a roll with reference to a shaft portion of the roll on which the endless member is wound, and the image of the endless member of the portion wound on the roll may be detected.

Meanwhile, since the endless member of the portion wound around the roll is curved, accuracy of detecting the image is decreased.

Aspects of non-limiting embodiments of the present disclosure relate to a transfer device and an image forming apparatus that suppress a decrease in image detection accuracy in a configuration in which a posture of an endless member is changed, as compared with a case where an image of an endless member of a curved portion wound around a roll is detected.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer device including: an endless member in an endless shape that orbits; primary transfer members that are respectively arranged on an opposite side of a plurality of image holding bodies disposed side by side in a circumference direction of the endless member with the endless member interposed between the primary transfer member and the image holding body, and transfer an image held by the image holding body to the endless member; a secondary transfer member that transfers the image transferred to the endless member to a recording medium; an applying roll around which the endless member is wound, that is disposed on a downstream side of all the primary transfer members and on an upstream side of the secondary transfer member in the circumference direction, and that urges the endless member from an inner peripheral surface of the endless member to apply tension to the endless member; an upstream roll around which the endless member is wound, and that is disposed on the downstream side of all the primary transfer members and on an upstream side of the applying roll in the circumference direction; a contact and detachment member that moves at least some of a plurality of the primary transfer members, and contacts and detaches the endless member and the image holding body to change a posture of the endless member; a detection member that faces a portion of the endless member between the upstream roll and the applying roll to detect the image transferred to the endless member; and a positioning mechanism that changes a posture of the detection member according to the change in the posture of the endless member to position the detection member at the endless member.

BRIEF DESCRIPTION OF THE DRAWINGS

Exemplary embodiment(s) of the present invention will be described in detail based on the following figures, wherein.

DETAILED DESCRIPTION

An example of a transfer device and an image forming apparatus according to an exemplary embodiment of the present disclosure will be described with reference to FIGS. 1 to 7. An arrow H illustrated in each diagram is a vertical direction and indicates an apparatus upward-downward direction, an arrow W is a horizontal direction and indicates an apparatus width direction, and an arrow D is the horizontal direction and indicates an apparatus depth direction.

Overall Configuration of Image Forming Apparatus 10

Figure 1:
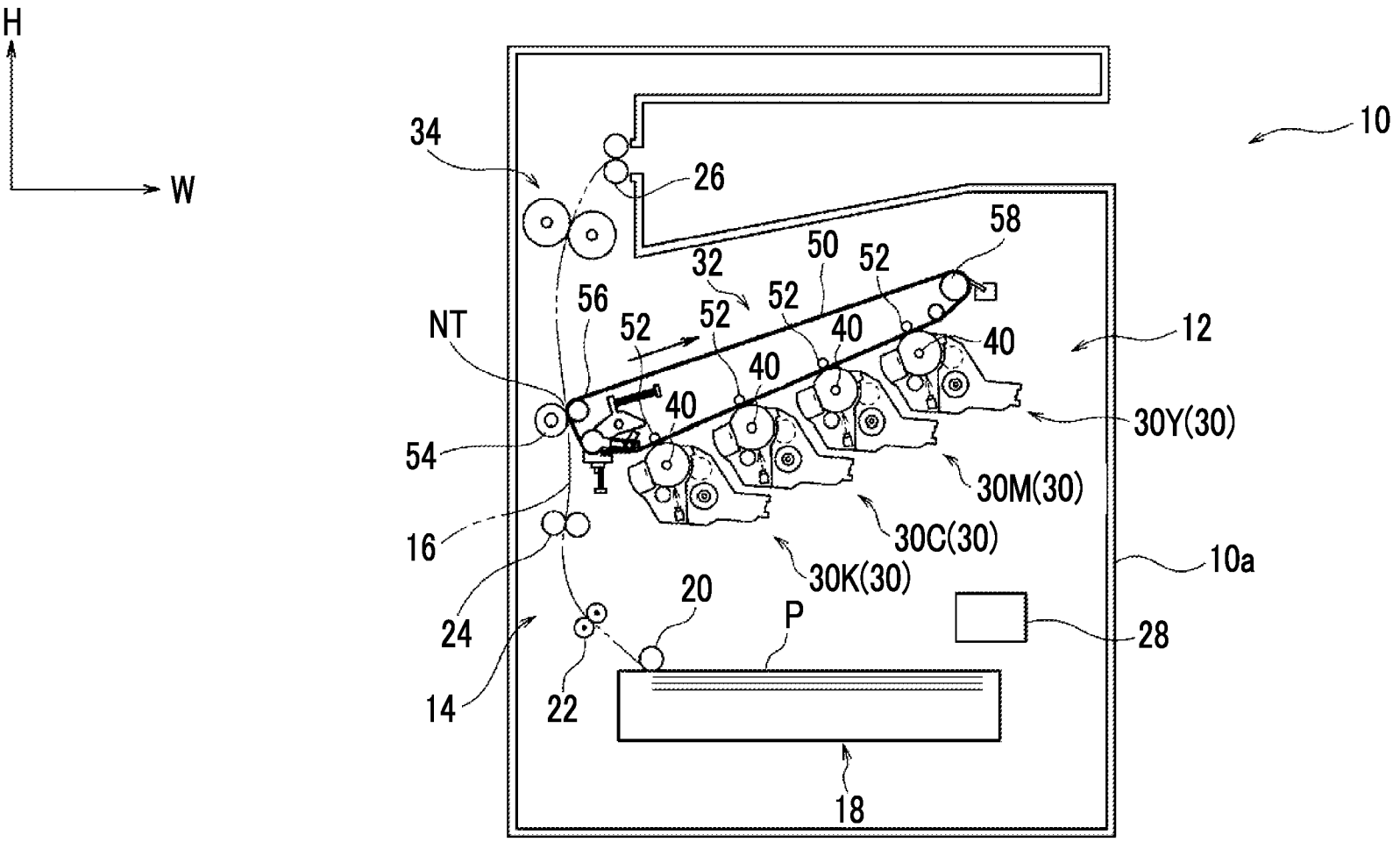
FIG. 1 is a schematic configuration diagram illustrating an image forming apparatus according to an exemplary embodiment of the present disclosure.

As illustrated in FIG. 1, an image forming apparatus 10 includes an image forming portion 12 that forms a toner image by an electrophotographic method, and a transport portion 14 that transports a sheet member P as a recording medium along a transport path 16. Further, the image forming apparatus 10 includes a housing member 18 accommodating the sheet member P and a control portion 28 that controls the entire apparatus.

In the image forming apparatus 10 having the configuration described above, the sheet member P accommodated in the housing member 18 is transported by the transport portion 14 along the transport path 16. Further, the toner image formed by the image forming portion 12 is formed on the sheet member P to be transported, and the sheet member P on which the toner image is formed is output to an outside of an apparatus main body 10*a*.

Image Forming Portion 12

As illustrated in FIG. 1, the image forming portion 12 includes a plurality of toner image forming portions 30 that form each toner image of each color, and a transfer portion 32 that transfers the toner image formed by the toner image forming portion 30 to the sheet member P. Further, the image forming portion 12 includes a fixing device 34 that fixes the toner image transferred to the sheet member P by the transfer portion 32 to the sheet member P.

Toner Image Forming Portion 30

The plurality of toner image forming portions 30 are provided to form a toner image for each color. The present exemplary embodiment provides toner image forming portions 30Y, 30M, 30C, and 30K having a total of four colors of yellow (Y), magenta (M), cyan (C), and black (K). In the following description, in a case where it is not necessary to distinguish between yellow (Y), magenta (M), cyan (C), and black (K), Y, M, C, and K attached to the reference numerals are omitted.

Figure 2:
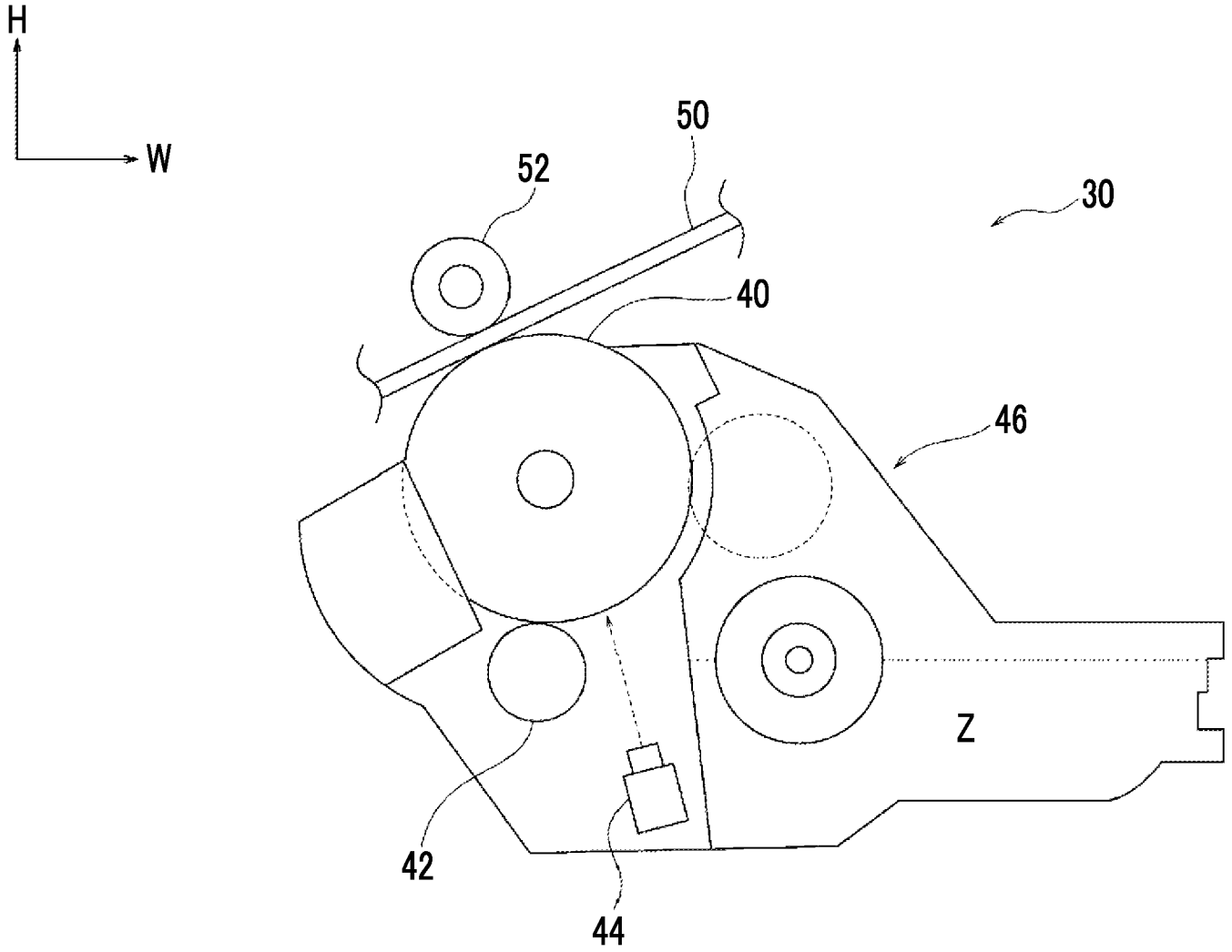
FIG. 2 is a configuration diagram illustrating a toner image forming portion of the image forming apparatus according to the exemplary embodiment of the present disclosure.

The toner image forming portion 30 of each color is basically configured in the same manner except for a toner to be used, and as illustrated in FIG. 2, a rotating cylindrical image holding body 40 and a charger 42 that charges the image holding body 40. Further, the toner image forming portion 30 includes an exposure device 44 that irradiates the charged image holding body 40 with exposure light to form an electrostatic latent image and a developing device 46 that develops the electrostatic latent image by using a developer Z containing a toner as a toner image. Therefore, the toner image forming portion 30 of each color forms an image of each color by using the toner of each color.

Further, as illustrated in FIG. 1, the image holding body 40 of each color is in contact with a transfer belt 50 (details will be described later) that moves around. In a circumference direction of the transfer belt 50 (see the arrow in FIG. 1), the toner image forming portions 30 of yellow (Y), magenta (M), cyan (C), and black (K) are arranged side by side in this order from the upstream side.

Transfer Portion 32

The transfer portion 32 has a function of transferring a toner image formed by the toner image forming portion 30 to the sheet member P. Details of the transfer portion 32 will be described later.

Fixing Device 34

As illustrated in FIG. 1, the fixing device 34 is disposed on a downstream side of a transfer nip NT in a transport direction of the sheet member P. The fixing device 34 heats and pressurizes a toner image transferred to the sheet member P to fix the toner image to the sheet member P.

Transport Portion 14

As illustrated in FIG. 1, the transport portion 14 includes a sending roll 20 that sends the sheet member P accommodated in the housing member 18 to the transport path 16 and a prevention roll 22 that prevents over-feeding of the sheet member P to be sent out by the sending roll 20. Further, the transport portion 14 includes an adjustment roll 24 that adjusts a timing of the sheet member P to be sent to the transfer nip NT, and an output roll 26 that outputs the sheet member P on which a toner image is fixed by the fixing device 34 to the outside of the apparatus main body 10*a*.

Central Portion Configuration

Next, the transfer portion 32 will be described. The transfer portion 32 is an example of a transfer device.

Figure 3:
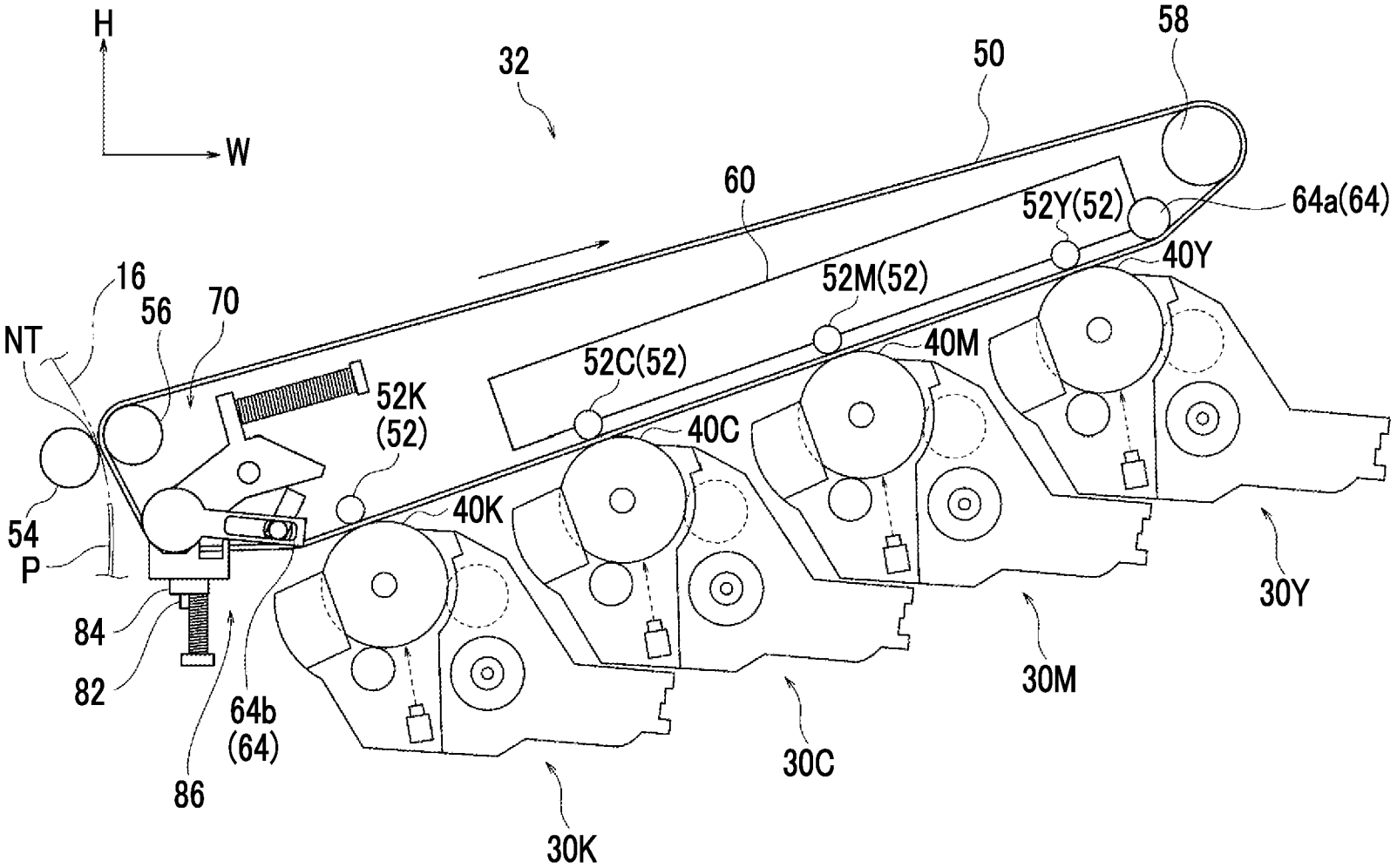
FIG. 3 is a front view illustrating a state of a color mode of a transfer device according to the exemplary embodiment of the present disclosure.

As illustrated in FIG. 3, the transfer portion 32 includes the transfer belt 50 and primary transfer rolls 52 that are respectively disposed on an opposite side of the image holding body 40 of each color with the transfer belt 50 interposed therebetween and transfer a toner image formed on the image holding body 40 of each color to the transfer belt 50. Further, the transfer portion 32 includes a contact and detachment member 60 that moves at least some primary transfer rolls 52 among a plurality of primary transfer rolls 52 to contact and detach the transfer belt 50 and the image holding body 40.

Further, the transfer portion 32 includes a winding roll 56 around which the transfer belt 50 is wound, a drive roll 58 around which the transfer belt 50 is wound and which transmits the rotational force to the transfer belt 50, and positioning rolls 64 that position a portion at which the toner image is to be transferred on the transfer belt 50. Further, the transfer portion 32 includes an applying unit 70 that applies tension to the transfer belt 50.

Further, the transfer portion 32 includes a detection member 82 that detects an image formed on the transfer belt 50, a holding member 84 that holds the detection member 82, and a positioning mechanism 86 that determines a position of the detection member 82 on the transfer belt 50.

Further, the transfer portion 32 is disposed on an opposite side of the winding roll 56 with the transfer belt 50 interposed therebetween, and includes a secondary transfer roll 54 that transfers the toner image transferred to the transfer belt 50 to the sheet member P. The transfer nip NT that transfers the toner image to the sheet member P is formed between the secondary transfer roll 54 and the transfer belt 50.

Transfer Belt 50, Winding Roll 56, and Drive Roll 58

As illustrated in FIG. 3, the transfer belt 50 has an endless shape, and is disposed to have a posture in which one end (left end in FIG. 3) in the apparatus width direction is downward with respect to the other end. The transfer belt 50 is an example of an endless member.

The winding roll 56 has an axial direction as the apparatus depth direction, and one end portion of the transfer belt 50 in the apparatus width direction is wound around the winding roll 56.

The drive roll 58 has an axial direction in the apparatus depth direction, and the other end portion of the transfer belt 50 in the apparatus width direction is wound around the drive roll 58.

In this configuration, the transfer belt 50 orbits in the arrow direction (clockwise direction) in FIG. 3 by rotating the drive roll 58 to which the drive force is transmitted from a driving source (not illustrated).

Primary Transfer Roll 52 and Secondary Transfer Roll 54

As illustrated in FIG. 3, the primary transfer roll 52 of each color is disposed on a downstream side of the drive roll 58 and on an upstream side of the winding roll 56 in a circumference direction of the transfer belt 50 (hereinafter, referred to as "belt circumference direction"). The primary transfer roll 52 of each color is in contact with an inner peripheral surface of the transfer belt 50, on an opposite side of the image holding body 40 of each color with the transfer belt 50 interposed therebetween. Further, the secondary transfer roll 54 is disposed on an opposite side of the winding roll 56 with the transfer belt 50 interposed therebetween. The primary transfer roll 52 is an example of a primary transfer member, and the secondary transfer roll 54 is an example of a secondary transfer member.

In this configuration, the primary transfer roll 52 of each color transfers a toner image formed on the image holding body 40 of each color to the transfer belt 50 in a state in which the transfer belt 50 is interposed between the primary transfer roll 52 and the image holding body 40 of each color. Further, the secondary transfer roll 54 transfers the toner image transferred to the transfer belt 50 by the primary transfer roll 52 to the sheet member P transported by the transfer nip NT.

Applying Unit 70 and Positioning Roll 64

Figure 5:
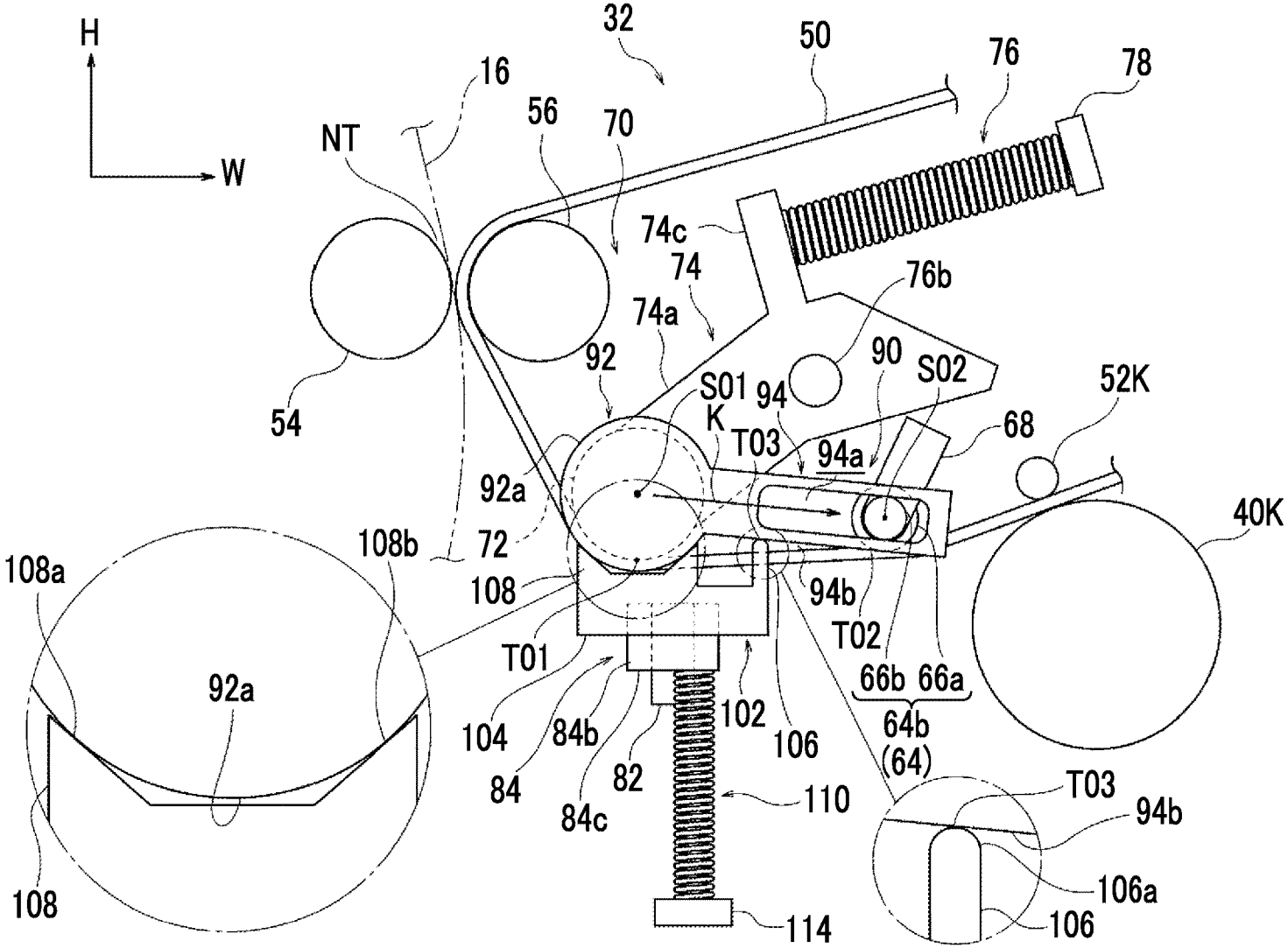
FIG. 5 is an enlarged front view illustrating the state of the color mode of the transfer device according to the exemplary embodiment of the present disclosure.

As illustrated in FIG. 3, the applying unit 70 is disposed at a portion surrounded by the transfer belt 50 and at one end side of the transfer belt 50 in the apparatus width direction. As illustrated in FIG. 5, the applying unit 70 includes an applying roll 72 around which the transfer belt 50 is wound, a support member 74 that rotatably supports the applying roll 72, and an urging member 76 that urges the applying roll 72 to the transfer belt 50 via the support member 74.

Applying Roll 72 of Applying Unit 70

As illustrated in FIG. 5, the applying roll 72 is disposed on a downstream side of the primary transfer roll 52K and on an upstream side of the secondary transfer roll 54 in the belt circumference direction, by using an axial direction as the apparatus depth direction. In other words, the applying roll 72 is disposed on a downstream side of all the primary transfer rolls 52 and on the upstream side of the secondary transfer roll 54, in the belt circumference direction. The applying roll 72 is in contact with the inner peripheral surface of the transfer belt 50.

Support Member 74 of Applying Unit 70

The support members 74 are provided on both sides of the applying roll 72 in the apparatus depth direction. As illustrated in FIG. 5, the support member 74 has a main body portion 74*a*, a shaft portion 74*b* constituting a rotation axis of the main body portion 74*a*, and a projecting portion 74*c* projecting from the main body portion 74*a*.

The shaft portion 74*b* is disposed on an upper side of the applying roll 72, and on the other side of the applying roll 72 in the apparatus width direction, with an axial direction as the apparatus depth direction. Further, the main body portion 74*a* extends from the shaft portion 74*b* toward the applying roll 72 side, and the applying roll 72 is rotatably attached to a tip portion of the main body portion 74*a*. Further, the projecting portion 74*c* projects upward from the main body portion 74*a*.

Urging Member 76 of Applying Unit 70

The urging members 76 are compression coil springs, and are provided on both sides of the applying roll 72 in the apparatus depth direction. As illustrated in FIG. 5, the urging member 76 is disposed to extend in a direction in which the transfer belt 50 extends, as viewed from the apparatus depth direction, and one end of the urging member 76 is attached to the projecting portion 74*c* and the other end of the urging member 76 is attached to the holding portion 78 provided in a frame (not illustrated).

In this configuration, the urging member 76 is disposed between the projecting portion 74*c* and the holding portion 78 in a compressed state, and urges the applying roll 72 in contact with the inner peripheral surface of the transfer belt 50 to the transfer belt 50. In this manner, tension is applied to the transfer belt 50. In other words, the applying roll 72 urges the inner peripheral surface of the transfer belt 50 toward an outer peripheral surface side of the transfer belt 50, so that tension is applied to the transfer belt 50.

Positioning Roll 64

A pair of positioning rolls 64 are provided with all the primary transfer rolls 52 therebetween in the belt circumference direction, with the axial direction as the apparatus depth direction, as illustrated in FIG. 3. Specifically, a positioning roll 64*a* disposed on an upstream side of all the primary transfer rolls 52 and a positioning roll 64*b* disposed on the downstream side of all the primary transfer rolls 52 in the belt circumference direction are provided. The positioning roll 64*b* is an example of an upstream roll.

Further, as illustrated in FIG. 5, the positioning roll 64*b* is disposed on the downstream side of all the primary transfer rolls 52 and on an upstream side of the applying roll 72 in the belt circumference direction. The positioning roll 64*b* has a cylindrical portion 66*a* in a cylindrical shape and a shaft portion 66*b* that is inserted into the cylindrical portion 66*a* and projects from both sides of the cylindrical portion 66*a*. The positioning roll 64*b* is rotatably supported by a support member 68 supported by a frame (not illustrated).

Contact and Detachment Member 60

As illustrated in FIG. 3, the contact and detachment member 60 is disposed at a portion surrounded by the transfer belt 50. The contact and detachment member 60 is configured by combining known mechanisms, and moves the positioning roll 64*a* and at least some primary transfer rolls 52 among the plurality of primary transfer rolls 52 to contact and detach the transfer belt 50 and the image holding body 40. In addition, the contact and detachment means contacting and separating.

Here, in the image forming apparatus 10, a color mode in which an image to be transferred to the sheet member P is formed by using the toner image forming portions 30Y, 30M, 30C, and 30K a black mode in which the image to be transferred to the sheet member P is formed by using only the toner image forming portion 30K are switched.

In this configuration, in a case where a user selects the color mode with an input screen (not illustrated), the contact and detachment member 60 arranges the positioning roll 64*a* and the primary transfer roll 52 so that the transfer belt 50 is interposed between all the primary transfer rolls 52 and all the image holding bodies 40, as illustrated in FIG. 3. As illustrated in FIG. 5, the applying roll 72 urges the inner peripheral surface of the transfer belt 50 toward the outer peripheral surface side of the transfer belt 50 to apply tension to the transfer belt 50.

Figure 4:
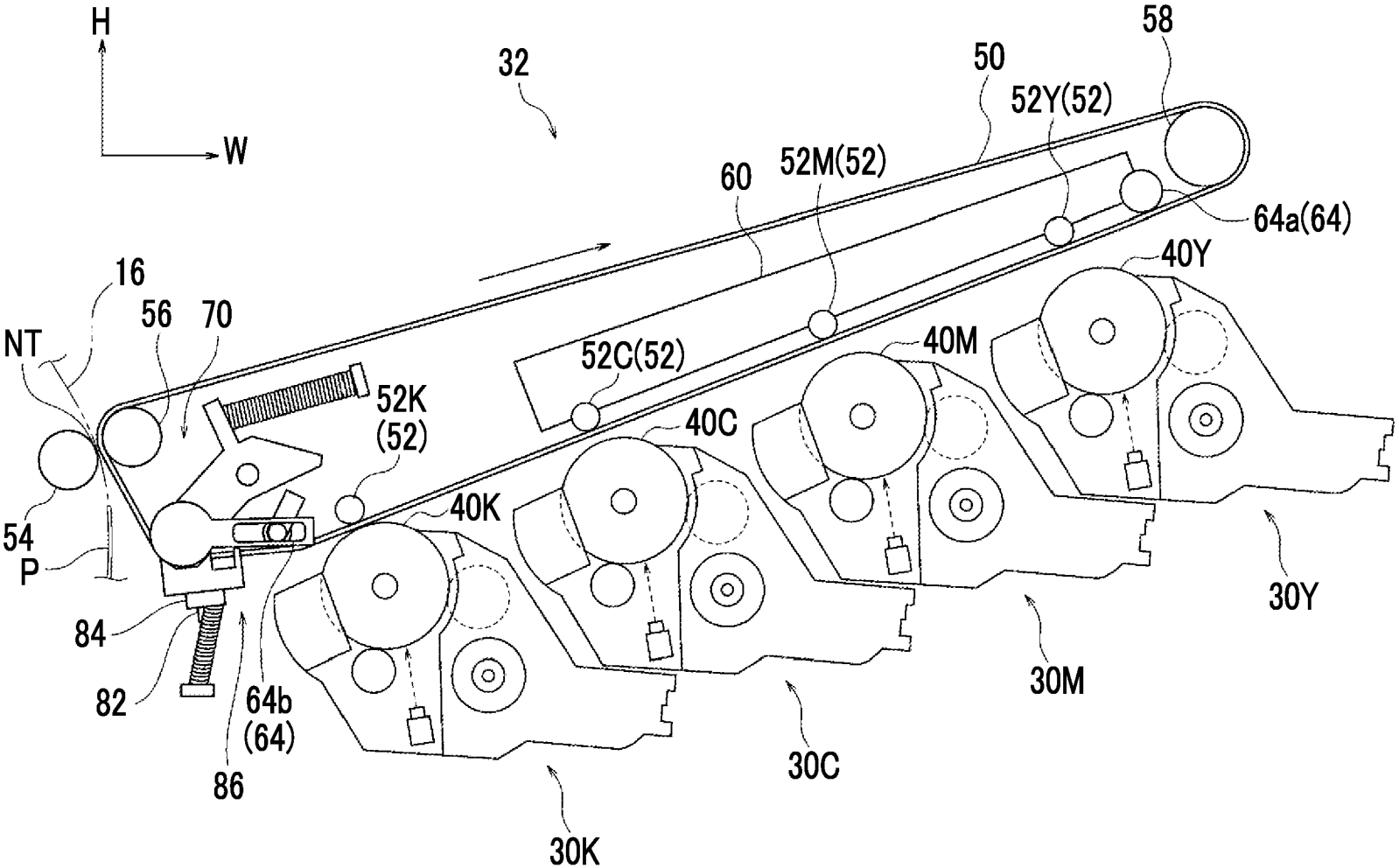
FIG. 4 is a front view illustrating a state of a black mode of the transfer device according to the exemplary embodiment of the present disclosure.
Figure 6:
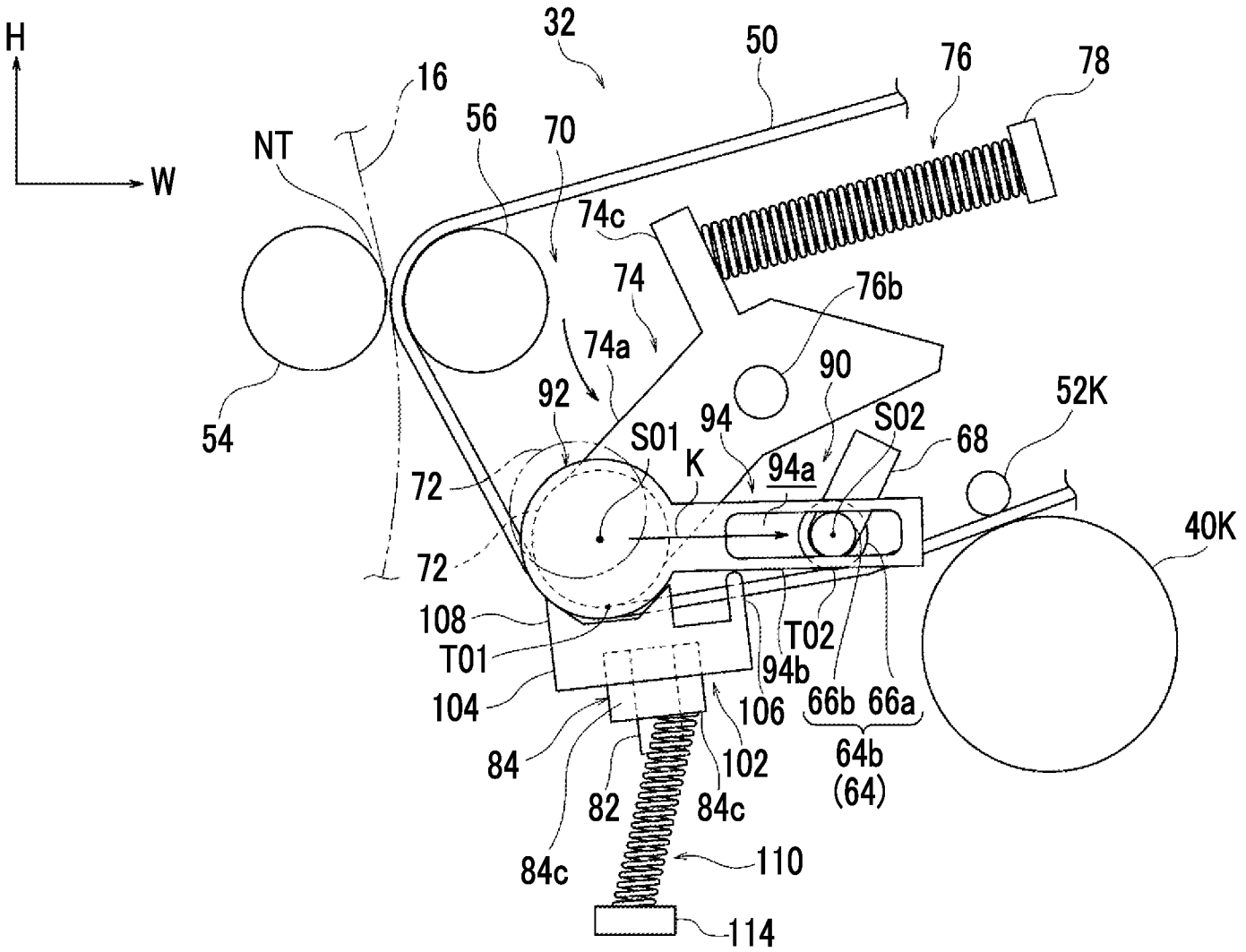
FIG. 6 is an enlarged front view illustrating the state of the black mode in the transfer device according to the exemplary embodiment of the present disclosure.

On the other hand, in a case where the user selects the black mode with the input screen (not illustrated), as illustrated in FIG. 4, the contact and detachment member 60 arranges the positioning roll 64*a* and the primary transfer roll 52 so that the transfer belt 50 is interposed only between the primary transfer roll 52 and the image holding body 40K. Here, as illustrated in FIG. 5, since the applying roll 72 urges the inner peripheral surface of the transfer belt 50 toward the outer peripheral surface side of the transfer belt 50, the applying roll 72 rotates to maintain the tension applied to the transfer belt 50, as illustrated in FIG. 6. Therefore, the transfer belt 50 is separated from the image holding bodies 40Y, 40M, and 40C (see FIG. 4).

In this manner, in the transfer portion 32, mode switching is performed between the color mode and the black mode. In the color mode and the black mode, in order to maintain the tension applied to the transfer belt 50, a posture of the transfer belt 50 at a downstream side portion of the drive roll 58 and at an upstream side portion of the secondary transfer roll 54 in the belt circumference direction is changed.

Detection Member 82 and Holding Member 84

Detection Member 82

Figure 7:
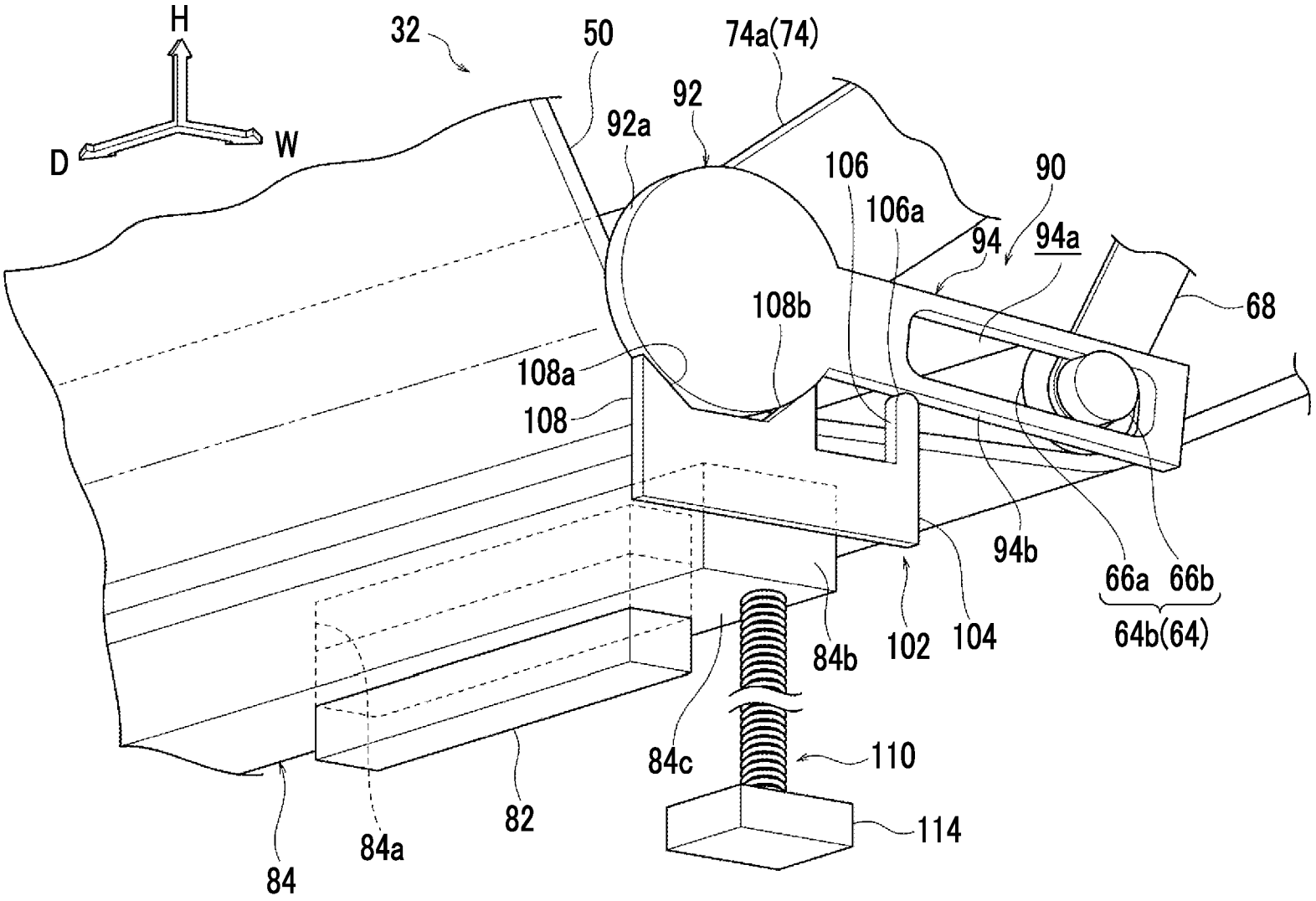
FIG. 7 is the transfer device according to the exemplary embodiment of the present disclosure, and is a perspective view illustrating a periphery of a detection member.

The detection member 82 is an optical sensor, has a rectangular parallelepiped shape extending in the apparatus depth direction, and faces an outer peripheral surface of a portion of the transfer belt 50 between the applying roll 72 and the positioning roll 64*b*, as illustrated in FIGS. 5 and 7. Specifically, the detection member 82 faces a portion of the transfer belt 50 between a position at which the transfer belt 50 is separated from the applying roll 72 (T01 illustrated in FIGS. 5 and 6) and a position at which the transfer belt 50 is separated from the positioning roll 64*b* (T02 illustrated in FIGS. 5 and 6) in a thickness direction of the transfer belt 50.

Further, a pair of detection members 82 are provided apart from each other in the apparatus width direction, and face the outer peripheral surface of the transfer belt 50 at an end side portion in the apparatus depth direction, as illustrated in FIG. 7.

In this configuration, the detection member 82 detects an image transferred to the transfer belt 50. Specifically, the detection member 82 detects a positional deviation of the image transferred to the transfer belt 50 and a concentration of the image.

Holding Member 84

As illustrated in FIG. 7, the holding member 84 has a rectangular parallelepiped shape extending in the apparatus depth direction, and is formed with a through-hole 84*a* penetrating in the upward-downward direction. Specifically, the through-hole 84*a* has a rectangular parallelepiped shape extending in the apparatus depth direction, and is formed at each end side portion of the holding member 84 in the apparatus depth direction.

By fitting the detection member 82 into the through-hole 84*a*, the holding member 84 holds the detection member 82.

Positioning Mechanism 86 and Others

As illustrated in FIGS. 5 and 7, the positioning mechanism 86 includes a long member 90, and a support member 102 which supports the detection member 82 via the holding member 84 and of which a posture is changed as a posture of the long member 90 is changed. Further, the transfer portion 32 includes an urging member 110 that forces the support member 102 to the long member 90.

Long Member 90

A pair of long members 90 are provided on both sides of the applying roll 72 in the apparatus depth direction, and are hung on a shaft of the applying roll 72 and a shaft of the positioning roll 64*b*, as illustrated in FIGS. 5 and 7.

Here, "being hung on the shaft of the applying roll 72 and the shaft of the positioning roll 64*b*" means that the applying roll 72 and the positioning roll 64*b* are coupled with each other so that a posture is changed as a relative position between a shaft center of the applying roll 72 and a shaft center of the positioning roll 64*b* is changed.

The long member 90 includes a disk portion 92 centered on the shaft center of the applying roll 72 and a long portion 94 extending from the disk portion 92 to the positioning roll 64*b*, as viewed from the apparatus depth direction.

The disk portion 92 has an outer diameter dimension larger than an outer diameter dimension of the applying roll 72, and is rotatably attached to the applying roll 72. Further, the disk portion 92 is formed with a peripheral surface 92*a* facing outward in a diameter direction.

The long portion 94 extends along a reference direction (arrow K illustrated in FIG. 5) from the shaft center of the applying roll 72 (S01 illustrated in FIG. 5) to the shaft center of the positioning roll 64*b* (S02 illustrated in FIG. 5), as viewed from the apparatus depth direction.

Further, the long portion 94 is a plate-shaped member having a plate thickness direction as the apparatus depth direction, and the long portion 94 is formed with an elongated hole 94*a* extending in the reference direction, as viewed from the apparatus depth direction. The shaft portion 66*b* of the positioning roll 64*b* is movably inserted into the elongated hole 94*a*. Further, the long portion 94 is formed with a long surface 94*b* facing the support member 102 and extending along the reference direction.

Support Member 102

A pair of support members 102 are provided on both sides of the transfer belt 50 in the apparatus depth direction, and are attached to the side surface 84*b* of the holding member 84, as illustrated in FIGS. 5 and 7.

The support member 102 is formed with a main body portion 104 to which the holding member 84 is attached, a contact portion 106 extending from the main body portion 104 toward the long portion 94 side and coming into contact with the long surface 94*b*, and a contact portion 108 extending from the main body portion 104 toward the disk portion 92 side and coming into contact with the peripheral surface 92*a*. The contact portion 108 is an example of another contact portion.

The contact portion 106 in a rod shape extends from the main body portion 104 toward the long portion 94, and an arcuate surface 106*a* having an arcuate shape as viewed from the apparatus depth direction is formed at a tip portion of the contact portion 106. The arcuate surface 106*a* is in contact with the long surface 94*b* of the long member 90.

The contact portion 108 is formed with one flat surface 108*a* and another flat surface 108*b* that come into contact with the peripheral surface 92*a*, as viewed from the apparatus depth direction. As viewed from the apparatus depth direction, the one flat surface 108*a* and the other flat surface 108*b* are disposed in a V shape. A position on the one flat surface 108*a* in contact with the peripheral surface 92*a* and a position on the other flat surface 108*b* in contact with the peripheral surface 92*a* are separated from each other in a circumferential direction of the peripheral surface 92*a*. In this manner, the contact portion 108 is in contact with the peripheral surface 92*a* of the disk portion 92 at two points from two different directions.

Urging Member 110

The urging member 110 is a compression coil spring, and as illustrated in FIGS. 5 and 7, a pair of urging members 110 are provided at both end portions of the holding member 84 in the apparatus depth direction. The urging member 110 extends in the upward-downward direction as viewed from the apparatus depth direction, one end of the urging member 110 is attached to a lower surface 84*c* of the holding member 84, and the other end of the urging member 110 is attached to a holding portion 114 provided on a frame (not illustrated).

The urging member 110 urges the support member 102 of a portion at a position (T03 illustrated in FIG. 5) at which the shaft center S01 of the applying roll 72 and the contact portion 106 come into contact with the long surface 94*b* of the long member 90 in the reference direction (arrow K illustrated in FIG. 5), as viewed from the apparatus depth direction. Specifically, the urging member 110 urges the support member 102 of a portion at the position T03 at which the shaft center S01 of the applying roll 72 and the contact portion 106 come into contact with the long surface 94*b* to the long member 90 via the holding member 84, in the reference direction.

Further, the shaft center S01 of the applying roll is located between two points at which the contact portion 108 contacts the peripheral surface 92*a* in the reference direction, as viewed from the apparatus depth direction.

Action of Central Portion Configuration

Next, an action of the transfer portion 32 will be described.

In a case of the color mode illustrated in FIG. 3, the contact and detachment member 60 of the transfer portion 32 disposes the positioning roll 64*a* and the primary transfer roll 52 so as to interpose the transfer belt 50 between all the primary transfer rolls 52 and all the image holding bodies 40.

Further, as illustrated in FIG. 5, the applying roll 72 urges the inner peripheral surface of the transfer belt 50 toward the outer peripheral surface side of the transfer belt 50 to apply tension to the transfer belt 50.

Further, the urging member 110 urges the support member 102 of a portion at the position T03 at which the shaft center S01 of the applying roll 72 and the contact portion 106 come into contact with the long surface 94*b* to the long member 90 via the holding member 84, in the reference direction. Therefore, the arcuate surface 106*a* of the contact portion 106 of the support member 102 comes into contact with the long surface 94*b* of the long member 90. Further, the one flat surface 108*a* and the other flat surface 108*b* of the contact portion 108 of the support member 102 come into contact with the peripheral surface 92*a* of the disk portion 92 of the long member 90.

Therefore, the detection member 82 held by the holding member 84 is positioned at the transfer belt 50 via the long member 90.

On the other hand, in a case of the black mode illustrated in FIG. 4, the contact and detachment member 60 of the transfer portion 32 disposes the positioning roll 64*a* and the primary transfer roll 52 so as to interpose the transfer belt 50 only between the primary transfer roll 52 and the image holding body 40K.

Therefore, the applying roll 72 rotates around the shaft portion 74*b*, and maintains the tension applied to the transfer belt 50, as illustrated in FIGS. 5 and 6. The posture of the transfer belt 50 is changed by the rotational movement of the applying roll 72, and the transfer belt 50 is separated from the image holding bodies 40Y, 40M, and 40C (see FIG. 4). Further, as the posture of the transfer belt 50 is changed, the posture of the long member 90 is also changed.

On the other hand, the urging member 110 urges the support member 102 of the portion at the position T03 at which the shaft center S01 of the applying roll 72 and the contact portion 106 come into contact with the long surface 94*b* to the long member 90 via the holding member 84, in the reference direction. Therefore, even in a case where the posture of the long member 90 is changed, the contact between the arcuate surface 106*a* of the contact portion 106 of the support member 102 and the long surface 94*b* of the long member 90 is maintained. Further, the contact between the one flat surface 108*a* and the other flat surface 108*b* of the contact portion 108 of the support member 102 and the peripheral surface 92*a* of the disk portion 92 of the long member 90 is maintained.

In this manner, a posture of the support member 102 is changed with the change in the posture of the long member 90, and the detection member 82 attached to the support member 102 via the holding member 84 is positioned on the transfer belt 50 via the long member 90.

As illustrated in FIGS. 5 and 6, the detection member 82 faces a portion of the transfer belt 50 between the position 101 at which the transfer belt 50 is separated from the applying roll 72 and the position T02 at which the transfer belt 50 is separated from the positioning roll 64*b* in a thickness direction of the transfer belt 50. In other words, the detection member 82 faces a flat portion of the transfer belt 50 in the thickness direction of the transfer belt 50.

SUMMARY

As described above, the posture of the transfer belt 50 is changed in the transfer portion 32. The positioning mechanism 86 changes a posture of the detection member 82 according to the change in the posture of the transfer belt 50 so as to position the detection member 82 on the transfer belt 50. Further, the detection member 82 faces the flat portion of the transfer belt 50, and detects an image of the transfer belt 50 in the flat portion. Therefore, with a configuration in which the posture of the transfer belt 50 is changed, it is possible to suppress a decrease in image detection accuracy, as compared with a case where the image of the curved portion wound around the applying roll is detected.

Further, in the transfer portion 32, the detection member 82 faces a portion of the transfer belt 50 between the position 101 at which the transfer belt 50 is separated from the applying roll 72 and the position T02 at which the transfer belt 50 is separated from the positioning roll 64*b* in a thickness direction of the transfer belt 50. Therefore, for example, the transfer portion 32 can be downsized in the apparatus width direction, as compared with a case where a detection member faces a portion of a transfer belt between the positioning roll 64*b* and the primary transfer roll 52K.

Further, in the transfer portion 32, the positioning mechanism 86 includes the long member 90 of which the posture is changed with the change in the posture of the transfer belt 50, and the support member 102 which supports the detection member 82 and of which the posture is changed with the change in the posture of the long member 90. In this manner, the posture of the detection member 82 is changed without detecting the change in the posture of the transfer belt 50.

Further, in the transfer portion 32, the urging member 110 urges the support member 120 to the long member 90. The contact portion 106 of the support member 102 comes into contact with the long surface 94*b* of the long member 90, and the contact portion 108 of the support member 102 comes into contact with the peripheral surface 92*a* of the disk portion 92 of the long member 90. Therefore, a state in which the support member 102 is in contact with the long member 90 is stabilized even in a case where the posture of the long member 90 is changed, as compared with a case where the support member is brought into contact with the long member by magnetic force.

Further, in the transfer portion 32, the contact portion 80 is formed with the arcuate surface 106*a* that comes into contact with the long surface 94*b* of the long member 90, as viewed from the apparatus depth direction. Therefore, it is possible to suppress a decrease in positioning accuracy for positioning the detection member 82 on the transfer belt 50 even in a case where the posture of the long member 90 is changed, as compared with a case where the portion of the contact portion in contact with the long member has a rectangular shape.

Further, in the transfer portion 32, the arcuate surface 106*a* of the contact portion 106 extends in the reference direction, and is in contact with the long surface 94*b* facing the contact portion 106 side. Therefore, as viewed from the apparatus depth direction, it is possible to suppress a decrease in positioning accuracy, as compared with a case where the long surface is inclined with respect to the reference direction.

Further, in the transfer portion 32, the urging member 110 urges a portion of the support member 102 between the shaft center S01 of the applying roll 72 and the position T03 at which the contact portion 106 comes into contact with the long member 90 via the holding member 84, in the reference direction. Therefore, the state in which the support member 102 is in contact with the long member 90 is stabilized even in a case where the posture of the long member 90 is changed, as compared with a case where the support member is urged at a portion different from the portion between the shaft center S01 and the position T03 in the reference direction.

Further, in the transfer portion 32, the shaft center S01 of the applying roll 72 is located between two points at which the contact portion 108 comes into contact with the peripheral surface 92*a* in the reference direction, as viewed from the apparatus depth direction. Therefore, in the reference direction as viewed from the apparatus depth direction, the state in which the contact portion 108 is in contact with the peripheral surface 92*a* is stabilized, as compared with a case where the two points at which the contact portion 108 comes into contact with the peripheral surface 92*a* are located on one side with respect to the shaft center S01 of the applying roll.

Further, in the image forming apparatus 10, with the configuration in which the posture of the transfer belt 50 is changed, a decrease in quality of an output image is suppressed, as compared with a case where a transfer portion for detecting the image of the curved portion wound around the roll is provided.

Although the specific exemplary embodiments of the present disclosure are described in detail, the exemplary embodiment of the present disclosure is not limited to such exemplary embodiments, and it is apparent to those skilled in the art that various other exemplary embodiments can be taken within the scope of the present disclosure. For example, in the exemplary embodiment described above, the urging member 110 that urges the support member 102 to the long member 90 is a compression coil spring, and the urging member 110 may be a tension coil spring, a torsion spring, or the like. In a case of the tension coil spring, one end of the coil may be disposed inside the transfer belt 50, as viewed from the apparatus depth direction.

Further, in the exemplary embodiment described above, the long member 90 is rotatably supported by the applying roll 72, and the long member 90 may be rotatably supported by the positioning roll 64*b*.

Further, in the exemplary embodiment described above, the color mode and the black mode are switched, and any mode may be used as long as the posture of the transfer belt 50 is changed.

Further, although not particularly described in the exemplary embodiment described above, the arcuate surface 106*a* formed on the contact portion 106 may be a curved surface in a convex shape or a V-shaped apex coming into contact with the long surface 94*b*.

Further, in the exemplary embodiment described above, the contact portion 106 is formed with the arcuate surface 106*a* which comes into contact with the long surface 94*b*, and the arcuate surface may not be formed. In this case, the action of forming the arcuate surface does not work.

Further, in the exemplary embodiment described above, the long surface 94*b* extends in the reference direction, and the long surface may be inclined with respect to the reference direction. In this case, the action that the long surface 94*b* extends in the reference direction does not work.

Further, in the exemplary embodiment described above, the posture of the support member 102 is changed with the change of the posture of the long member 90, and the support member may be brought into contact with the end portion of the transfer belt to change the posture of the support member as the posture of the transfer belt is changed. In this case, the action of changing the posture of the support member 102 with the change of the posture of the long member 90 does not work.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

an endless member in an endless shape that orbits;

primary transfer members that are respectively arranged on an opposite side of a plurality of image holding bodies disposed side by side in a circumference direction of the endless member with the endless member interposed between the primary transfer member and the image holding body, and transfer an image held by the image holding body to the endless member;

a secondary transfer member that transfers the image transferred to the endless member to a recording medium;

an applying roll around which the endless member is wound, that is disposed on a downstream side of all the primary transfer members and on an upstream side of the secondary transfer member in the circumference direction, and that urges the endless member from an inner peripheral surface of the endless member to apply tension to the endless member;

an upstream roll around which the endless member is wound, and that is disposed on the downstream side of all the primary transfer members and on an upstream side of the applying roll in the circumference direction;

a contact and detachment member that moves at least some of a plurality of the primary transfer members, and contacts and detaches the endless member and the image holding body to change a posture of the endless member;

a detection member that faces a portion of the endless member between the upstream roll and the applying roll to detect the image transferred to the endless member; and a positioning mechanism that changes a posture of the detection member according to the change in the posture of the endless member to position the detection member at the endless member.

2. The transfer device according to claim 1,
wherein the positioning mechanism includes
a long member hung on a shaft of the applying roll and a shaft of the upstream roll, and
a support member that supports the detection member and has a posture changed according to a change in a posture of the long member.

3. The transfer device according to claim 2,
wherein the long member is formed with a disk portion centered on a shaft center of the applying roll,
the support member is formed with a contact portion that comes into contact with the long member and another contact portion that comes into contact with a peripheral surface of the disk portion in at least two directions, and
an urging member that urges the support member to the long member is provided.

4. The transfer device according to claim 3,
wherein the contact portion is formed with an arcuate surface that comes into contact with the long member, as viewed from an axial direction of the applying roll.

5. The transfer device according to claim 4,
wherein the long member is formed with a long surface that extends along a reference direction from the shaft center of the applying roll toward a shaft center of the upstream roll and faces a contact portion side, as viewed from the axial direction, and
the arcuate surface is in contact with the long surface.

6. The transfer device according to claim 5,
wherein in a reference direction from the shaft center of the applying roll toward a shaft center of the upstream roll as viewed from the axial direction of the applying roll, the urging member urges a portion of the support member between the shaft center of the applying roll and a position at which the contact portion comes into contact with the long member.

7. The transfer device according to claim 6,
wherein the other contact portion is in contact with the peripheral surface at two points separated in a circumferential direction, and
in the reference direction as viewed from the axial direction, the shaft center of the applying roll is located between the two points at which the other contact portion is in contact with the peripheral surface.

8. An image forming apparatus comprising:
an image forming portion that forms an image; and
the transfer device according to claim 6 that transfers the image formed by the image forming portion to a recording medium.

9. An image forming apparatus comprising:
an image forming portion that forms an image; and
the transfer device according to claim 5 that transfers the image formed by the image forming portion to a recording medium.

10. The transfer device according to claim 4,
wherein in a reference direction from the shaft center of the applying roll toward the shaft center of the upstream roll as viewed from the axial direction of the applying roll, the urging member urges a portion of the support member between the shaft center of the applying roll and a position at which the contact portion comes into contact with the long member.

11. The transfer device according to claim 10,
wherein the other contact portion is in contact with the peripheral surface at two points separated in a circumferential direction, and
in the reference direction as viewed from the axial direction, the shaft center of the applying roll is located between the two points at which the other contact portion is in contact with the peripheral surface.

12. An image forming apparatus comprising:
an image forming portion that forms an image; and
the transfer device according to claim 10 that transfers the image formed by the image forming portion to a recording medium.

13. An image forming apparatus comprising:
an image forming portion that forms an image; and
the transfer device according to claim 4 that transfers the image formed by the image forming portion to a recording medium.

14. The transfer device according to claim 3,
wherein in a reference direction from the shaft center of the applying roll toward a shaft center of the upstream roll as viewed from an axial direction of the applying roll, the urging member urges a portion of the support member between the shaft center of the applying roll and a position at which the contact portion comes into contact with the long member.

15. The transfer device according to claim 14,
wherein the other contact portion is in contact with the peripheral surface at two points separated in a circumferential direction, and
in the reference direction as viewed from the axial direction, the shaft center of the applying roll is located between the two points at which the other contact portion is in contact with the peripheral surface.

16. An image forming apparatus comprising:
an image forming portion that forms an image; and
the transfer device according to claim 15 that transfers the image formed by the image forming portion to a recording medium.

17. An image forming apparatus comprising:
an image forming portion that forms an image; and
the transfer device according to claim 14 that transfers the image formed by the image forming portion to a recording medium.

18. An image forming apparatus comprising:
an image forming portion that forms an image; and
the transfer device according to claim 3 that transfers the image formed by the image forming portion to a recording medium.

19. An image forming apparatus comprising:
an image forming portion that forms an image; and
the transfer device according to claim 2 that transfers the image formed by the image forming portion to a recording medium.

20. An image forming apparatus comprising:
an image forming portion that forms an image; and
the transfer device according to claim 1 that transfers the image formed by the image forming portion to a recording medium.

* * * * *